US008677561B2

(12) United States Patent
Woo

(10) Patent No.: US 8,677,561 B2
(45) Date of Patent: Mar. 25, 2014

(54) AUTOMATIC DOOR CLOSURE UNIT

(76) Inventor: Saeng Yoon Woo, Yongin-si (KR)

( * ) Notice: Subject to any disclaimer, the term of this patent is extended or adjusted under 35 U.S.C. 154(b) by 0 days.

(21) Appl. No.: 13/392,284

(22) PCT Filed: Aug. 25, 2010

(86) PCT No.: PCT/KR2010/005684

§ 371 (c)(1),
(2), (4) Date: Feb. 24, 2012

(87) PCT Pub. No.: WO2011/025251

PCT Pub. Date: Mar. 3, 2011

(65) Prior Publication Data

US 2012/0144623 A1 Jun. 14, 2012

(30) Foreign Application Priority Data

Aug. 26, 2009 (KR) ..... 10-2009-0079324

(51) Int. Cl.
*E05F 3/00* (2006.01)

(52) U.S. Cl.
USPC ..... 16/65; 16/49

(58) Field of Classification Search
USPC ..... 16/71–81, 49–53, DIG. 9, 65, 70, 16/82–86 C, 54, 55, 285, 374–375
See application file for complete search history.

(56) References Cited

U.S. PATENT DOCUMENTS 2,115,968 A * 5/1938 Sherwood ..... 16/52
2,490,258 A * 12/1949 Diebel ..... 16/54
2,493,116 A * 1/1950 Diebel ..... 16/301
2,707,796 A * 5/1955 Hawks ..... 16/52
3,357,040 A * 12/1967 MacDonald ..... 16/51

(Continued)

FOREIGN PATENT DOCUMENTS

JP 51-122927 10/1976
KR 20-0190952 5/2000

(Continued)

OTHER PUBLICATIONS

International Search Report—PCT/KR2010/005684 dated Apr. 26, 2011.

*Primary Examiner* — Victor Batson
*Assistant Examiner* — Matthew Sullivan
(74) *Attorney, Agent, or Firm* — Cantor Colburn LLP

(57) ABSTRACT

The present invention relates to an automatic door closer including: a main housing having the shape of a cylinder; a damper housing adapted to divide the interior of the main housing into an upper chamber and a lower chamber and having oil charged thereinto and a fixed vane formed at one side of the inner peripheral surface thereof in such a manner as to be projected toward the center thereof; a cover fixedly coupled to the upper periphery of the main housing; an activating shaft having one end extended to the outside through the cover in such a manner as to be rotatably supported and the other end rotatably supported against the bottom surface of the main housing through the damper housing; a rotary vane formed integrally to the outer periphery of the activating shaft so as to divide the interior of the damper housing into first and second chambers, together with the fixed vane; a return spring adapted to provide a returning force of returning the activating shaft to an initial setting position at the time when the door is closed; and damping means adapted to selectively provide a damping function if the activating shaft and the rotary vane are rotated in a closing direction of the door.

13 Claims, 17 Drawing Sheets

(56) References Cited

U.S. PATENT DOCUMENTS

| | | | | |
|---|---|---|---|---|
| 4,155,144 | A * | 5/1979 | Koganei | 16/54 |
| 4,825,503 | A * | 5/1989 | Shiramasa et al. | 16/52 |
| 4,829,628 | A * | 5/1989 | Vuksic | 16/54 |
| 5,111,548 | A * | 5/1992 | Ohshima | 16/51 |
| 6,154,924 | A * | 12/2000 | Woo | 16/62 |
| 6,253,417 | B1 * | 7/2001 | Rusiana | 16/82 |
| 6,629,334 | B2 * | 10/2003 | Huang | 16/50 |
| 6,725,503 | B1 * | 4/2004 | Lin | 16/76 |
| 7,155,776 | B2 * | 1/2007 | Park | 16/50 |
| 7,865,999 | B2 * | 1/2011 | Hilger | 16/65 |

FOREIGN PATENT DOCUMENTS

| | | |
|---|---|---|
| KR | 10-2003-0080750 | 10/2003 |
| KR | 10-2006-0009722 | 2/2006 |
| KR | 10-2008-0078317 | 8/2008 |

* cited by examiner

AUTOMATIC DOOR CLOSURE UNIT

TECHNICAL FIELD

The present invention relates to an automatic door closer unit, and more particularly, to an automatic door closer that is simple in configuration, thereby making it easy to perform its machining, and that has hydraulic circuits, through which oil is guided at the time when a door is open and closed, provided independently of each other, thereby ensuring good stability in operation and preventing the oil charged into the inside from leaking to the outside.

BACKGROUND ART

Generally, a door closer is an automatic door closing device that is installed on a large-sized steel door like a fire-proof door and is automatically returned slowly to its original position after the door is open.

Conventional automatic door closers have various structures in accordance with the kinds of door. Among them, there has been proposed Korean Patent No. 446221 issued to the same applicant as the present invention, which discloses an automatic door closer having a compact volume capable of improving the merchantability and mechanical durability thereof.

By the way, the conventional automatic door closers are configured wherein so as to control a door closing speed, a hydraulic circuit for adjusting an amount of oil and a hydraulic circuit of a check valve are operated cooperatively to each other, thereby making it difficult to perform the machining and raising the cost of the product. Moreover, the two hydraulic circuits are provided in the state of being not isolated from each other and have influences on each other, thereby decreasing the stability of the operation of the product.

Besides, in the conventional door closers, a shaft is disposed pierced through an outside housing and an adjuster is disposed on the side thereof, so that if fire occurs, the sealing is damaged by the external heat to cause the charged oil to leak to the outside and further to make the fire transferred to the back surface of a fire-proof door through the leaking oil.

DISCLOSURE

Technical Problem

Accordingly, the present invention has been made in view of the above-mentioned problems occurring in the prior art, and it is an object of the present invention to provide an automatic door closer that can have a hydraulic circuit for damping and a hydraulic circuit for controlling a door closing speed, through which oil is guided at the time when a door is open and closed, provided independently of each other, thereby ensuring the stability of the operation thereof and simply adjusting the door closing speed.

It is another object of the present invention to provide an automatic door closer that is capable of completely preventing the oil charged thereinto from leaking to the outside, thereby being appropriately applied to a fire-proof door.

It is yet another object of the present invention to provide an automatic door closer that can adopt a spiral spring having a substantially low stress variation value, thereby enabling a user to open a door, without the application of any strong force thereto, and can provide a good elastic force at the time when the door is closed, thereby gently performing the door closing operation.

It is still another object of the present invention to provide an automatic door closer that can be simple in configuration, be minimized in the number of parts, and adopt a detachable coupling structure in which easy assembling is achieved, so that the machining and assembling are excellent and the whole size is compact.

It is still yet another object of the present invention to provide an automatic door closer that can have a rotary vane and an activating shaft formed integrally to each other and modularized, thereby improving the assembility and durability thereof.

It is still another object of the present invention to provide an automatic door closer that can basically prevent the generation of metal chips caused by the friction between parts during the operation, thereby keeping hydraulic circuits from being malfunctioned by means of the metal chips.

Technical Solution

To accomplish the above objects, according to an aspect of the present invention, there is provided an automatic door closer including: a main housing mounted on a door and having the shape of a cylinder having a closed lower portion; a damper housing disposed along the inner periphery of the upper portion of the main housing so as to divide the interior of the main housing into an upper chamber and a lower chamber, the damper housing having oil charged thereinto and a fixed vane formed at one side of the inner peripheral surface thereof in such a manner as to be projected toward the center thereof; a cover adapted to be fixedly coupled to the upper periphery of the main housing so as to maintain the sealing state with the damper housing; an activating shaft having one end extended to the outside through the cover in such a manner as to be rotatably supported and the other end rotatably supported against the bottom surface of the main housing through the damper housing, the one end extended to the outside being connected to a door frame through a link; a rotary vane formed integrally to the outer periphery of the activating shaft so as to divide the interior of the damper housing into first and second chambers, together with the fixed vane; a return spring mounted in the lower chamber in such a manner as to be compressed at the time when the door is open the door and to provide a returning force of returning the activating shaft to an initial setting position at the time when the door is closed; and damping means adapted to control the opening and closing speeds of the door and to selectively provide a damping function if the activating shaft and the rotary vane are rotated in a closing direction of the door by means of the returning force of the return spring.

According to the present invention, preferably, the damping means includes a check valve disposed at a first hydraulic circuit, formed on the rotary vane and moving to the first and second chambers, so as to open the first hydraulic circuit at the time when the door is open and to shut the first hydraulic circuit at the time when the door is closed.

According to the present invention, preferably, the automatic door closer further includes closing speed-controlling means adapted to control the closing speed of the door through the adjustment of an amount of oil moving between the first and second chambers.

According to the present invention, preferably, the closing speed-controlling means includes: a second hydraulic circuit moving to the first and second chambers from the front and rear ends of the rotary vane through the intermediate portion of the activating shaft; and a speed-adjusting bolt disposed at the second hydraulic circuit so as to control the closing speed of the door through the adjustment of an amount of oil of the second hydraulic circuit.

According to the present invention, preferably, the second hydraulic circuit includes: a first passage extended from the front end of the rotary vane to the intermediate portion of the activating shaft in such a manner as to communicate with the first chamber; a second passage parallel to the first passage at a different height from the first passage and extended from the rear end of the rotary vane to the intermediate portion of the activating shaft in such a manner as to communicate with the second chamber; and a connection passage communicating with the first passage and the second passage in a perpendicular relation with the first passage and the second passage, and wherein the speed-adjusting bolt is screw-coupled to the activating shaft in the vertical direction so as to adjust the opening degree of the connection passage.

According to the present invention, preferably, the check valve includes: the first hydraulic circuit formed on the rotary vane so as to move to the first and second chambers; and a ball valve disposed in the first hydraulic circuit so as to open the first hydraulic circuit at the time when the door is open and to shut the first hydraulic circuit at the time when the door is closed.

According to the present invention, preferably, the automatic door closer further includes closing speed-controlling means by angle adapted to reduce the damping force generated by the damping means when the activating shaft and the rotary vane are rotated in the closing direction of the door, by predetermined angle section, so as to control the closing speed of the door by angle.

According to the present invention, preferably, the closing speed-controlling means by angle includes at least one accelerating groove formed on the bottom surface of the damper housing to form at least one accelerating section in the circumferential direction, and the section where the accelerating groove is not formed is set as a delaying section delaying the closing speed of the door.

According to the present invention, preferably, the automatic door closer further includes an initial position-setting protrusion formed at one side of the fixed vane along the inner peripheral surface of the damper housing so as to set an initial position of the door; and an opening angle-restricting member disposed at the other side of the fixed vane so as to restrict the opening angle of the door.

According to the present invention, preferably, the automatic door closer further includes a first bearing disposed on the bottom surface of the main housing so as to rotatably support the lower portion of the activating shaft; and a second bearing having a top portion disposed on the cover so as to rotatably support the upper portion of the activating shaft.

According to the present invention, preferably, the return spring is disposed with an elastic force in the main housing in such a manner as to be rotated to a given angle in one direction and to provide a final closing force at the time when the door is closed.

According to the present invention, preferably, the automatic door closer further includes a rail member disposed on the top end of a door frame and having a rail groove; a link member having one end connected to the upper portion of the activating shaft; and a roller member adapted to slidingly connect the other end of the link member along the rail groove of the rail member.

According to the present invention, preferably, the automatic door closer is disposed on the door by means of a fixing bracket, and the upper portion of the activating shaft is connected to the door frame through a two-bar linkage.

According to the present invention, preferably, the automatic door closer further includes: a first hinge extended from an extended portion in such a manner as to be bent perpendicularly thereto and fixed to the side of the door, the extended portion being extended from one side of the main housing so as to form a contacted surface with the door; and a second hinge having upper and lower coupling portions being coupled to both end portions of the activating shaft extended up and down from the main housing and a connection portion adapted to connect the upper and lower coupling portion to each other, the second hinge being extended from the upper and lower coupling portions in such a manner as to be bent perpendicularly thereto and fixed to the side of the door frame.

To accomplish the above objects, according to an aspect of the present invention, there is provided an automatic door closer including: a rail member disposed on the top end of a door frame and having a rail groove; a door closer unit disposed on the top side of a door so as to provide an automatic returning force to the door at the time when the door is open; a link member having one end connected to the upper portion of an activating shaft of the door closer unit; and a roller member adapted to slidingly connect the other end of the link member along the rail groove of the rail member.

Advantageous Effect

According to the present invention, the automatic door closer is capable of completely preventing the oil charged thereinto from leaking to the outside, so that when disposed on a fire-proof door, it can keep fire from occurring by means of the oil leaking to the outside.

In addition, the automatic door closer has the hydraulic circuits for the oil moving between the first and second chambers at the time when the door is open and closed in such a manner as to be formed independently of each other, through the damper housing and the activating shaft, which is unlike the conventional practice, thereby ensuring the stability of the operation thereof, improving the function of the check valve, and more precisely adjusting the door closing speed through the speed-adjusting bolt.

Further, the automatic door closer is simple in configuration, is minimized in the number of parts, and has a detachable coupling structure in which easy assembling is achieved, such that the machining and assembling are excellent and the whole size is compact.

Furthermore, the automatic door closer adopts the spiral spring having a substantially low stress variation value, thereby enabling a user to open the door, without the application of any strong force thereto, and provides a good elastic force at the time when the door is closed, thereby gently performing the door closing operation.

BEST MODE FOR INVENTION

Hereinafter, an explanation on an automatic door closer according to the present invention will be in detail given with reference to the attached drawings.

Figure 1:
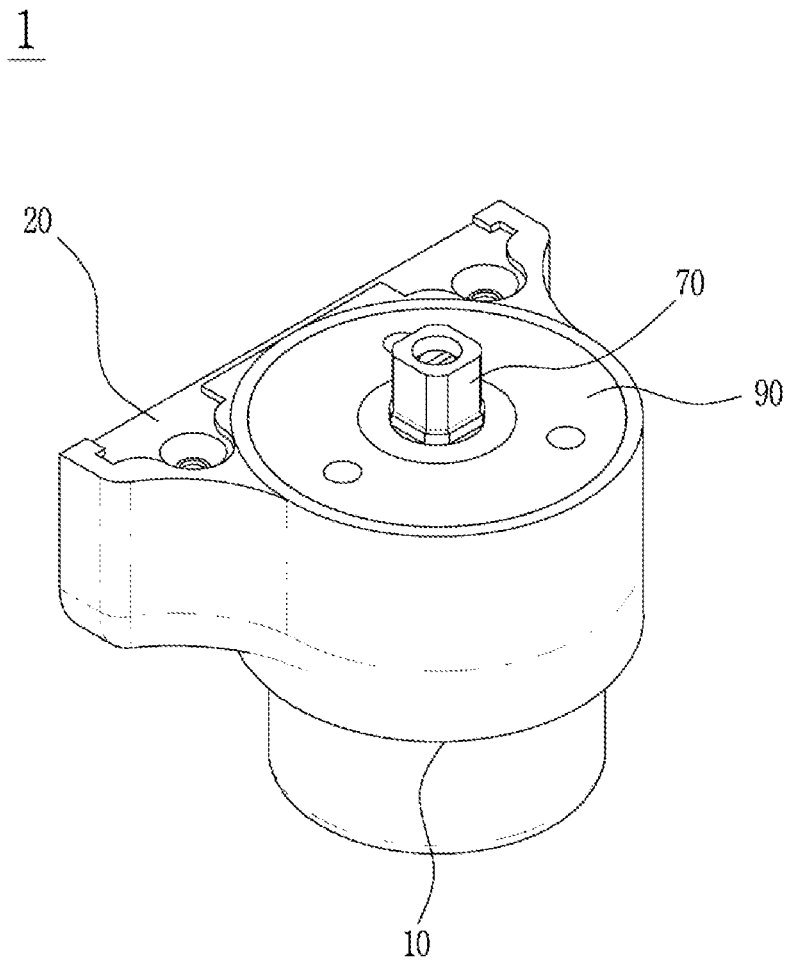
FIG. 1 is a perspective view showing an automatic door closer according to the present invention.
Figure 2:
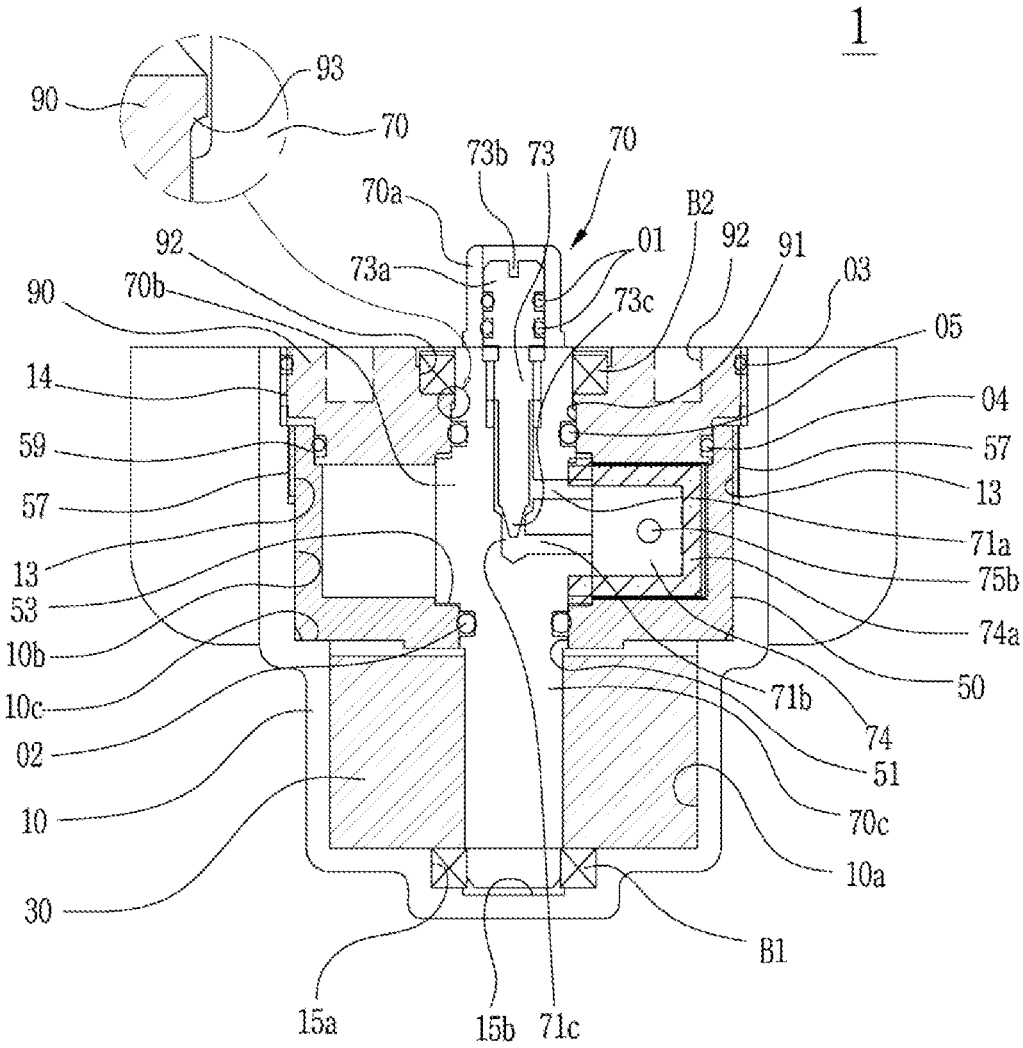
FIG. 2 is a longitudinal sectional view showing the automatic door closer of FIG. 1.
Figure 3:
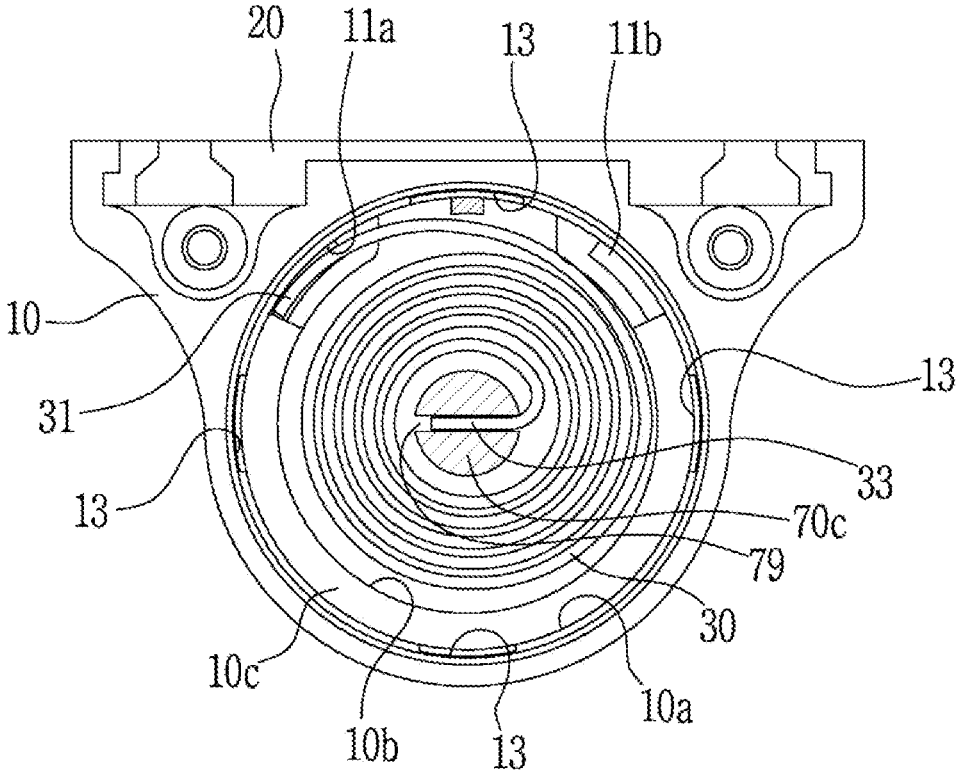
FIG. 3 is a plan view showing a state where a spiral spring is disposed on a main housing in the automatic door closer according to the present invention.
Figure 4:
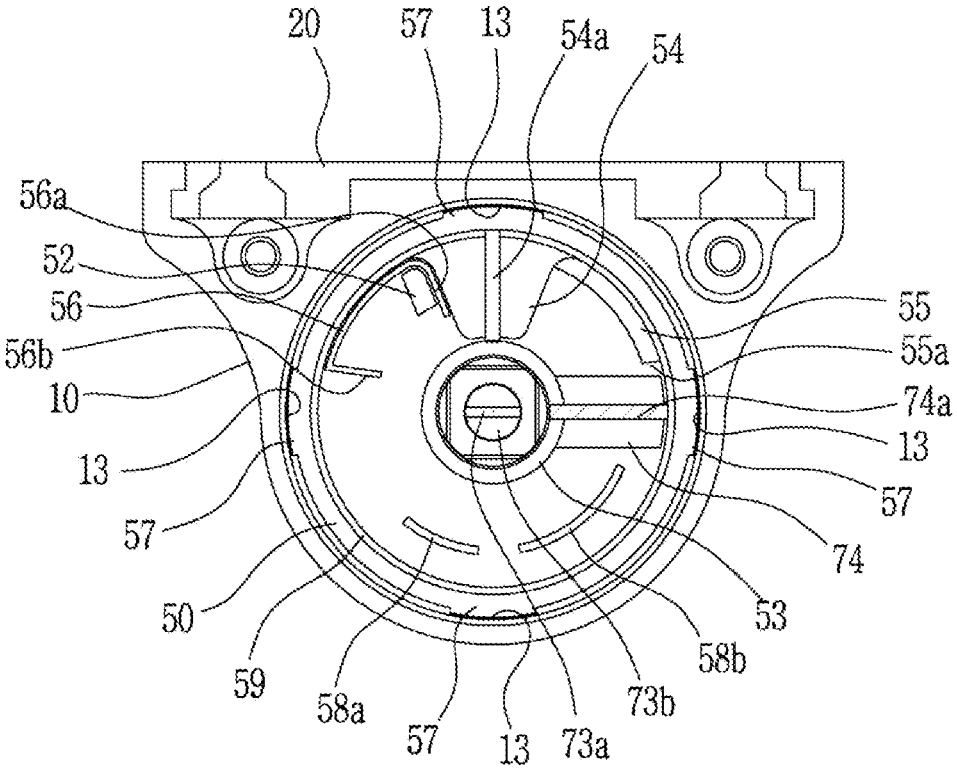
FIG. 4 is a plan view showing the automatic door closer from which a cover is removed.
Figure 5:
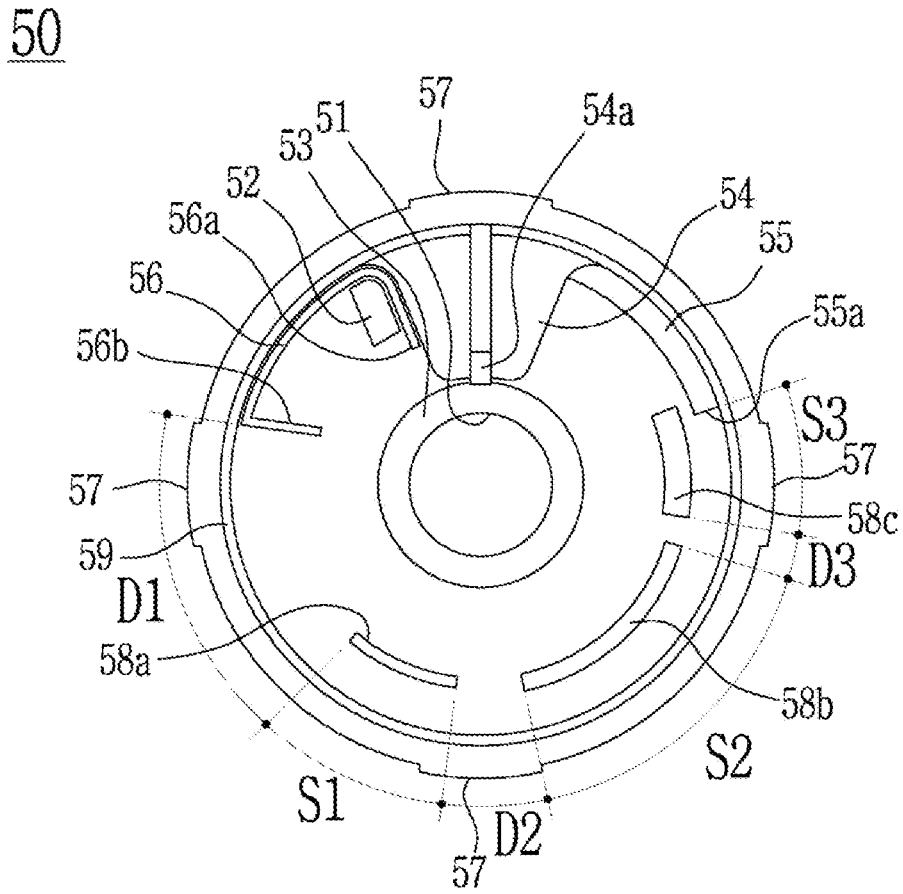
FIG. 5 is a plan view showing a damper housing in the automatic door closer according to the present invention.
Figure 6:
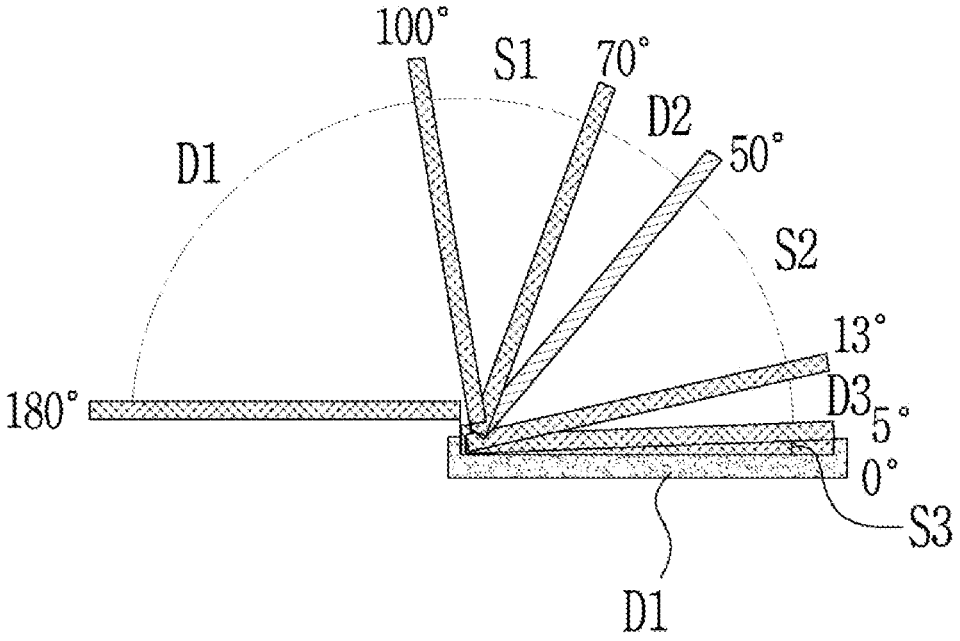
FIG. 6 is a schematic view showing open positions of a door corresponding to the delaying sections and the accelerating sections of door closing speeds indicated in FIG. 5.
Figure 7:
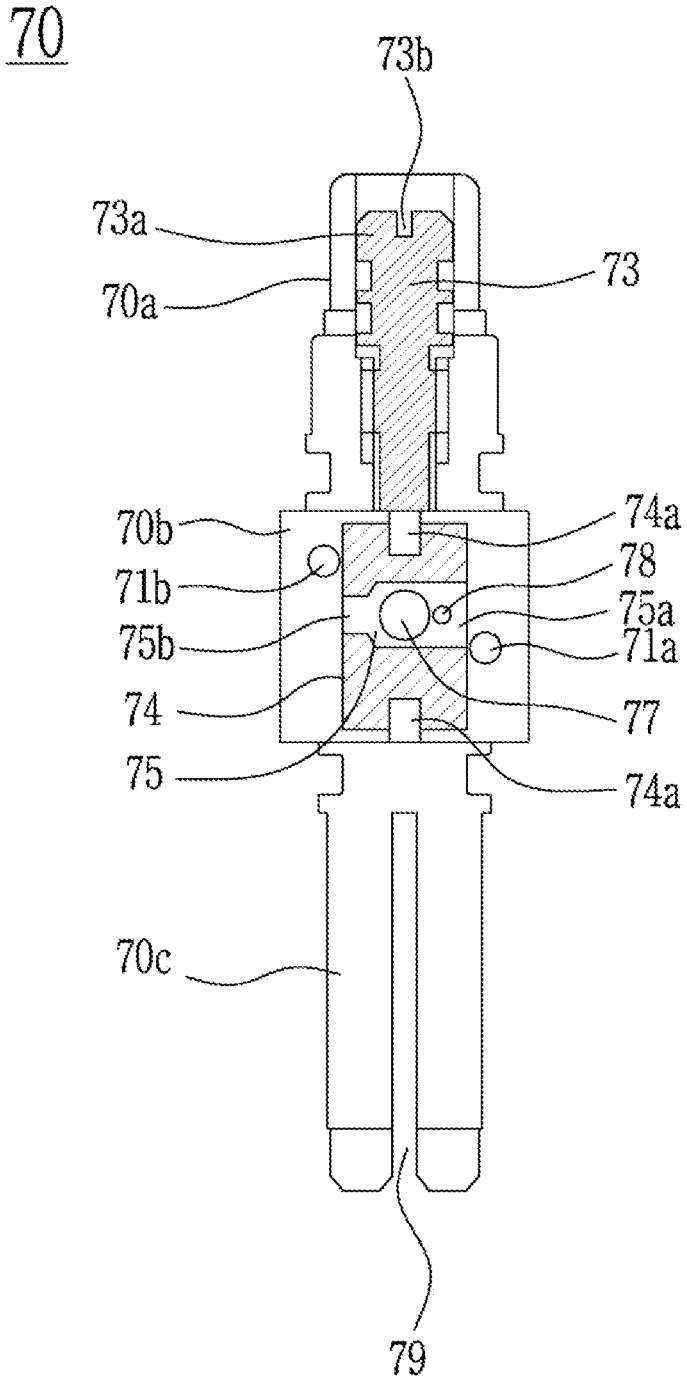
FIGS. 7 and 8 are sectional views showing an activating shaft in the automatic door closer according to the present invention.
Figure 8:
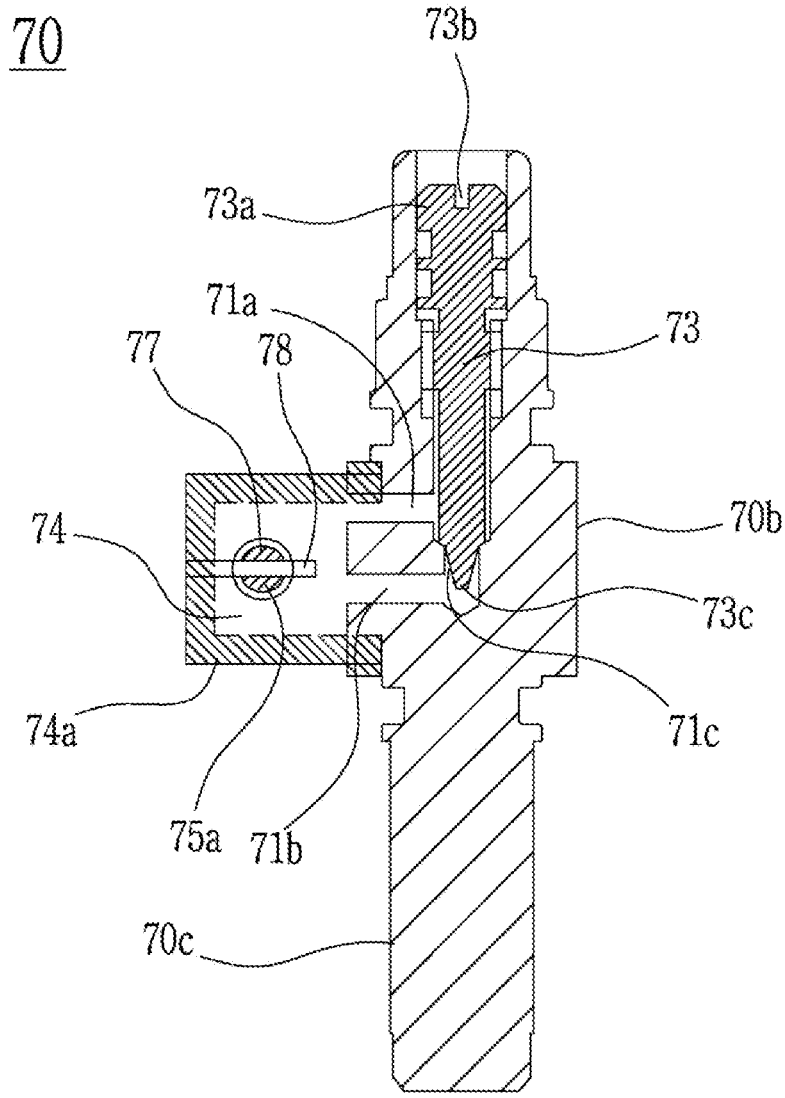

FIG. 1 is a perspective view showing an automatic door closer according to the present invention, FIG. 2 is a longitudinal sectional view showing the automatic door closer of FIG. 1, FIG. 3 is a plan view showing a state where a spiral spring is disposed on a main housing in the automatic door closer according to the present invention, FIG. 4 is a plan view showing the automatic door closer from which a cover is removed, FIG. 5 is a plan view showing a damper housing in the automatic door closer according to the present invention, FIG. 6 is a schematic view showing open positions of a door corresponding to the delaying sections and the accelerating sections of door closing speeds indicated in FIG. 5, and FIGS. 7 and 8 are sectional views showing an activating shaft in the automatic door closer according to the present invention.

Referring to FIGS. 1 and 2, a door closer 1 according to the present invention largely includes a main housing 10, a spiral spring 30, a damper housing 50, an activating shaft 70 and a cover 90.

Referring to FIGS. 2 and 3, the main housing 10 has the shape of a cylinder being open on the top end thereof and closed on the bottom end thereof and has the spiral spring 30, the damper housing 50, and the activating shaft 70 insertedly disposed at the inside thereof, while being closed on the open top end thereof by means of the cover 90. Like this, the main housing 10 is closed on the bottom end thereof, thereby basically preventing the incompressible oil charged in the interior of the main housing 10 or the damper housing 50 from leaking from the bottom end of the main housing 10.

The main housing 10 has a lower chamber 10*a* formed on the lower portion of the inside thereof, into which the spiral spring 30 is inserted, and an upper chamber 10*b* formed on the upper portion of the inside thereof, into which the damper housing 50 is inserted. In this case, the upper chamber 10*b* has a larger diameter than the lower chamber 10*a*, and through the difference between the diameters of the upper chamber 10*b* and the lower chamber 10*a*, a stage protrusion 10*c* is formed along the boundary between the upper chamber 10*b* and the lower chamber 10*a*, along which the underside end of the damper housing 50 is seated.

The lower chamber 10*a* has a pair of spring-fixing grooves 11*a* and 11*b* formed symmetrically on both sides of the inner peripheral surface thereof. The formation of the pair of spring-fixing grooves 11*a* and 11*b* enables a right type spiral spring or a left type spiral spring to be selectively used in accordance with the opening directions of a door D. Also, oil is supplied to the lower chamber 10*a* so as to maintain the lubrication and durability of the spiral spring 30 and to absorb the noise generated upon the operation of the spiral spring 30.

The spiral spring 30 serves as a return spring which is compressed at the time when the door D is open and supplies a returning force to permit the activating shaft 70 to be returned to an initial setting position at the time when the door D is closed. According to the present invention, the spiral spring 30 is used as the return spring, but it may be used as a variety of springs like a torsion spring, and so on, only if the activating shaft 70 is returned to the initial setting position.

The upper chamber 10*b* has a plurality of damper housing-fixing grooves 13 formed along the inner peripheral surface thereof in the circumferential direction and a screw portion 14 formed along the upper side of the inner peripheral surface thereof, to which the outer periphery of the cover 90 is screw-coupled.

The main housing 10 has a bearing insertion groove 15*a* formed on the bottom surface thereof so as to insert a lower bearing B1 thereinto, and the bearing-inserting groove 15*a* has a shaft-supporting groove 15*b* formed stepped on the center thereof so as to seat the lower end of the activating shaft 70 thereon.

The main housing 10 has a rear side coupled to a fixing bracket 20, and through the fixing bracket 20, the main housing 10 is fixedly mounted on the door D. In case where the door closer 1 is mounted on the door D, first, the fixing bracket 20 is fixed to a door wall by means of fixing screws, and then, the main housing 10 is coupled to the fixing bracket 20 and fastened thereto by means of fixing screws.

Referring to FIG. 3, the spiral spring 30 is a right type spiral spring which has one end disposed at the outermost side fixed to the left side spring-fixing groove 11*a* of the pair of spring-fixing grooves 11*a* and 11*b* and the other end disposed at the innermost side fixed to a slit 79 (see FIG. 7) formed on the lower portion of the activating shaft 70. Accordingly, if an external force applied to the door D disappears after the door D is open, the spiral spring 30 rotates the activating shaft 70 to a door closing position by means of its elastic force.

On the other hand, the spiral spring 30 has a relatively lower elastic coefficient than the torsion spring or compression spring used in the conventional door closer, so that the door D can be open without the application of lots of force thereto.

Referring to FIGS. 2 and 4, the damper housing 50 has the shape of a cylinder open on the upper end thereof and has a height lower than the upper chamber 10*b*. The damper housing 50 has a through-hole 51 formed on the center of the bottom surface thereof so as to permit the activating shaft 70 to be rotatably passed therethrough and a first seating groove 53 formed around the through-hole 51 so as to seat an intermediate portion 70*b* of the activating shaft 70 thereon.

Further, the damper housing 50 has a fixed vane 54 formed as an integral body thereto at one side of the inner peripheral surface thereof in such a manner as to be projected toward the center thereof. The fixed vane 54 has a first packing 54*a* coupled to the front end thereof, and the first packing 54*a* is brought into close contact with the intermediate portion 70*b* of the activating shaft 70. The fixed vane 54 and a rotary vane 74 as will be discussed later serve to divide the interior of the damper housing 50 into first and second chambers C1 and C2.

Moreover, the damper housing 50 has an initial position-setting protrusion 55 formed at one side of the fixed vane 54 along the inner peripheral surface thereof so as to set an initial position of the door D and an opening angle-restricting member 56 disposed at the other side of the fixed vane 54 so as to restrict the opening angle of the door D. The opening angle-restricting member 56 has one side 56*a* fixed by means of a fixing protrusion 52 formed near the fixed vane 54 and the other side 56*b* formed bent to restrict the rotation of the rotary vane 74. In this case, the angle between a front end 55*a* of the protrusion 55 for setting the initial position of the door D and the other side 56*b* of the opening angle-restricting member 56 corresponds to a desired opening angle of the door D.

Further, the damper housing 50 has a plurality of coupling protrusions 57 formed along the outer peripheral surface thereof in such a manner as to be insertedly coupled to the plurality of damper housing-fixing grooves 13. The coupling of the plurality of coupling protrusions 57 to the damper housing-fixing grooves 13 prevents the damper housing 50 from being rotated together with the activating shaft 70 within the upper chamber 10*b* during the rotation of the activating shaft 70.

Referring to FIG. 5, the damper housing 50 has first to third accelerating grooves 58*a* to 58*c* spaced apart from each other by a given distance on the bottom surface thereof in the circumferential direction. The first to third accelerating grooves 58*a* to 58*c* serve as a passage along which oil moves from the first chamber C1 to the second chamber C2 at the time when the door D is closed. The first to third accelerating grooves 58*a* to 58*c* become first to third accelerating sections S1 to S3 accelerating the closing speed at the time when the door D is closed, and a section D1 between the opening angle-restricting member 56 and the first accelerating groove 58*a* and sections D2 and D3 between the first accelerating groove 58*a* and the second accelerating groove 58*b* and between the second accelerating groove 58*b* and the third accelerating groove 58*c* correspond to first to third delaying sections D1, D2 and D3 delaying the closing speed of the door D.

Referring to FIG. 6, the first to third accelerating sections S1, S2 and S3 and the first to third delaying sections D1, D2 and D3 correspond to the respective opening angles of the door D, as shown in Table 1. As appreciated from Table 1, the first to third accelerating sections S1, S2 and S3 and the first to third delaying sections D1, D2 and D3 are disposed in an alternating manner, and accordingly, the closing speed of the door D is appropriately adjusted to prevent a user from hurting by means of the closing door and to keep the door D from strongly colliding against a door frame F.

TABLE 1

| Door Opening Angle | Accelerating Section | Delaying Section |
|---|---|---|
| 180°~100° | — | D1 |
| 100°~70° | S1 | — |
| 70°~50° | — | D2 |
| 50°~13° | S2 | — |
| 13°~5° | — | D3 |
| 5°~0° | S3 | — |

Among the above sections, the third delaying section D3 is a section finally delaying the closing speed of the door D so as to protect a user's hand if the user's hand is caught between the door D and the door frame F, and the third accelerating section S3 is a section accelerating the closing speed of the door D so as to permit a latch (not shown) of the door D to be locked to a locking groove (not shown) formed on the door frame F.

Moreover, the first to third accelerating grooves 58*a* to 58*c* have different lengths and widths from each other in accordance with the kinds of door, thereby making possible to appropriately adjust the closing speed of the door.

The accelerating and delaying sections will be in detail explained when the operation of the automatic door closer according to the present invention will be described.

Additionally, the damper housing 50 has a second seating groove 59 formed along the inner peripheral surface of the top end thereof so as to seat the underside end of the cover 90 thereon.

Referring to FIGS. 7 and 8, the activating shaft 70 has first and second passages 71*a* and 71*b* formed at the inside of the intermediate portion 70*b* thereof. The first and second passages 71*a* and 71*b* are formed perpendicularly relative to the axial direction of the activating shaft 70, and they communicate with each other by means of a connection passage 71*c* formed in the axial direction of the activating shaft 70. The first and second passages 71*a* and 71*b* and the connection passage 71*c* form a second hydraulic circuit determining the closing speed of the door D at the time when the door D is closed.

Further, the activating shaft 70 has a speed-adjusting bolt 73 detachably inserted from the front end of an upper portion 70*a* into the connection passage 71*c* along the axial direction thereof. In this case, the speed-adjusting bolt 73 is sealed by means of a plurality of O-rings O1 inside the activating shaft 70 so as to prevent oil from leaking to the outside.

If the speed-adjusting bolt 73 is rotated by a given angle in a clockwise or counterclockwise direction, a front end 73*c* of the speed-adjusting bolt 73 adjusts the opening degree of the connection passage 71*c* to control the amount of oil passed through the connection passage 71*c*, thereby adjusting the closing speed of the door D. In this case, the speed-adjusting bolt 73 has a head portion 73*a* having an adjusting groove 73*b* formed to insert the front end of a driver thereinto, so that a tool like a driver can be used by a user to easily rotate the speed-adjusting bolt 73. The second hydraulic circuit and the speed-adjusting bolt 73 constitute door closing speed-controlling means.

Furthermore, the activating shaft 70 has the rotary vane 74 formed on one surface of the intermediate portion 70*b* in such a manner as to be protruded to a position near the inner peripheral surface of the damper housing 50. The rotary vane 74 has a second packing 74*a* coupled to the front end thereof, and the second packing 74*a* is brought into close contact with the inner peripheral surface of the damper housing 50. Further, the rotary vane 74 has a check valve 77 adapted to move the oil within the first and second chambers C1 and C2 only in one direction during the rotation together with the activating shaft 70. The check valve 77 permits the oil within the second chamber C2 to move to the first chamber C1 at the time when the door D is open, and contrarily, restricts the movement of the oil within the first chamber C1 to the second chamber C2. At the time when the door D is closed, accordingly, the oil in the first chamber C1 is passed sequentially through the first passage 71*a*, the connection passage 71*c* and the second passage 71*b* and is then moved to the second chamber C2.

The check valve 77 includes an oil-passing hole 75 passed through the rotary vane 74 and a ball valve 77*a* disposed movably in the oil-passing hole 75 so as to open and close the oil-passing hole 75. In this case, the oil-passing hole 75 has a first inlet 75*a* communicating with the first chamber C1, which is formed larger than a second inlet 75*b* communicating with the second chamber C2, and a pin 78 is disposed on the first inlet 75*a* side so as to prevent the ball valve 77*a* from escaping from the oil-passing hole 75. In this case, the oil-passing hole 75 formed to pass through the rotary vane 74 forms a first hydraulic circuit.

According to the present invention, the check valve 77 is adopted by using the ball valve 77*a*, but it is possible to adopt a check valve structure having various known shapes like a plate valve.

Further, when the activating shaft 70 is inserted into the through-hole 51 of the damper housing 50, it is sealed by means of O-rings O2, thereby preventing the oil in the damper housing 50 from leaking to the main housing 10.

Furthermore, the activating shaft 70 has the fixing slot 79 formed at the lower portion 70*c* in such a manner as to fixedly insert the other end 53 of the spiral spring 30 thereinto.

If the activating shaft 70 and the damper housing 50 are coupled to each other, the sealing between the first chamber C1 and the second chamber C2 is achieved by means of the first packing 54*a* and the second packing 74*a*, and also, the sealing between the activating shaft 70 and the damper housing 50 is achieved by means of the O-rings O2, thereby making it possible to perform the sealing in a simple manner.

Referring to FIG. 2, the open end of the top side of the main housing 10 is closed by means of the cover 90, and at the same time, the sealing among the main housing 10, the damper housing 50 and the activating shaft 70 is achieved by means of a plurality of O-rings O3, O4, and O5.

Also, the cover 90 has a through-hole 91 formed on the center thereof, through which the upper portion 70*a* of the activating shaft 70 is passed, and a bearing insertion groove formed around the through-hole 91 so as to insert a bearing B2 thereinto and to rotatably support the activating shaft 70 thereagainst.

Further, the cover 90 has a deviation-preventing protrusion 93 formed along the inner periphery of the through-hole 91 so as to prevent the deviation of the activating shaft 70.

The door closer 1 having the above-mentioned configuration according to the present invention is assembled through the following procedure.

First, the bearing B1 is pressed and fitted to the bearing insertion groove 15*a* of the main housing 10, and then, the spiral spring 30 is inserted into the lower chamber 10*a*. In this case, one end 31 of the spiral spring 30 is fixed to the spring-fixing groove 11*a* of the main housing 10.

Next, the O-rings O2 and O5 are mounted along the outer periphery of the activating shaft 70, and the second packing 74*a* is mounted on the rotary vane 74 of the activating shaft 70. Moreover, the first packing 54*a* is mounted on the fixed vane 54 of the damper housing 50.

In this state, the activating shaft 70 is insertedly coupled to the through-hole 51 of the damper housing 50 and is then modularized. At this time, the rotary vane 74 of the activating shaft 70 is located at an initial setting position indicated on a given position on the damper housing 50.

After that, the coupled body between the activating shaft 70 and the damper housing 50 is first inserted into the upper chamber 10*b* of the main housing 10. In this case, the other end 33 of the spiral spring 30 is inserted into the fixing slit 79 of the activating shaft 70, thereby connecting the activating shaft 70 and the spiral spring 30 to each other.

In this state, the coupled body between the activating shaft 70 and the damper housing 50 is rotated by about 180° to 200° and it is then pressed and fitted to the main housing 10 at a point where the center of the fixed vane 54 of the damper housing 50 and the center of the main housing 10 correspond to each other, thereby inserting the lower portion 70*c* of the activating shaft 70 into the bearing B1. Accordingly, the door closer according to the present invention has a last closing force of the door D, that is, a force of inserting the latch of the door D into the locking groove of the door frame F.

After that, oil with high viscosity and incompressibility is charged into the first and second chambers C1 and C2 of the damper housing 50. The oil charging may be performed in a vacuum state after the cover 90 has been assembled.

After that, the O-rings O3 and O4 are mounted along the outer periphery of the cover 90, and the bearing B2 is inserted into the bearing insertion groove 92. Next, the cover 90 is screw-coupled to the main housing 10. At this time, if the cover 90 is completely coupled to the main housing 10, the underside surface of the cover 90 is brought into close contact with the interior of the upper portion of the damper housing 50, thereby achieving the sealing in the interior of the damper housing 50.

After that, residual oil is removed, and the speed-adjusting bolt 73 is assembled to the upper end of the activating shaft 70, thereby completing the assembly of the door closer according to the present invention.

Now, an explanation on the operation of the door closer according to the present invention will be given with reference to FIGS. 5 and 6 and FIGS. 9 to 11.

The closed state of the door D, that is, the initial state of the door D is when one surface of the rotary vane 74 comes into close contact with the front end 55*a* of the initial position setting protrusion 55.

Figure 9:
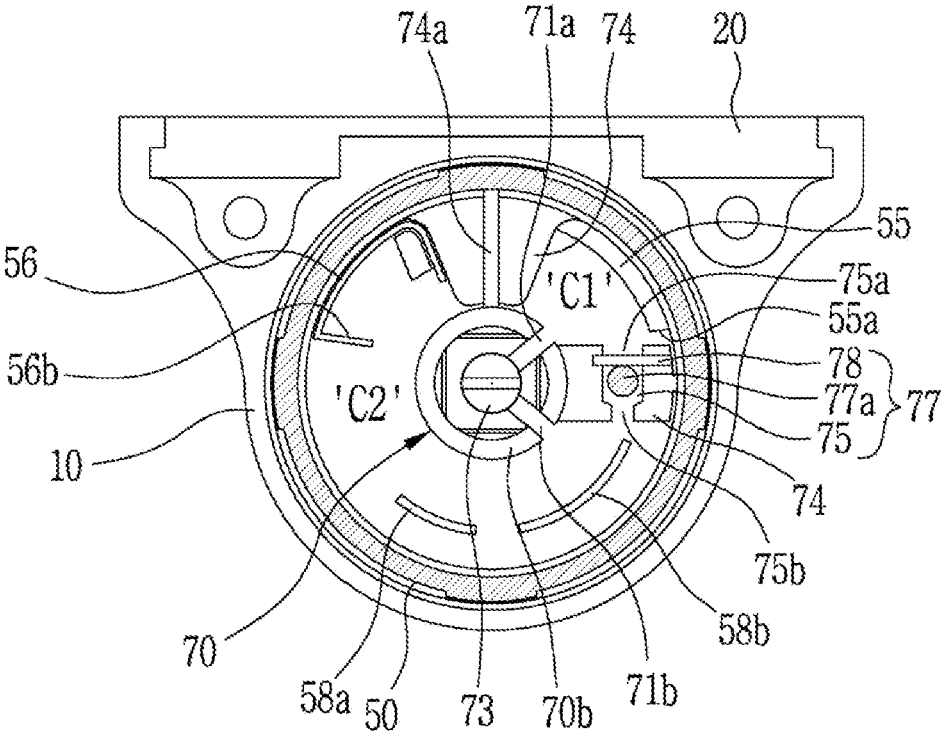
FIGS. 9 to 11 are schematic plan views showing the opening and closing states of a check valve in accordance with the open sections of the door.

If the door D is open in the initial state, as shown in FIG. 9, the rotary vane 74 of the activating shaft 70 is rotated in the clockwise direction to pressurize the oil in the second chamber C2. As a result, the oil around the second inlet 75*b* of the oil-passing hole 75 is introduced into the second inlet 75*b* to push the ball valve 77*a* toward the first inlet 75*a*, thereby gently opening the first inlet 75*a*.

Figure 10:
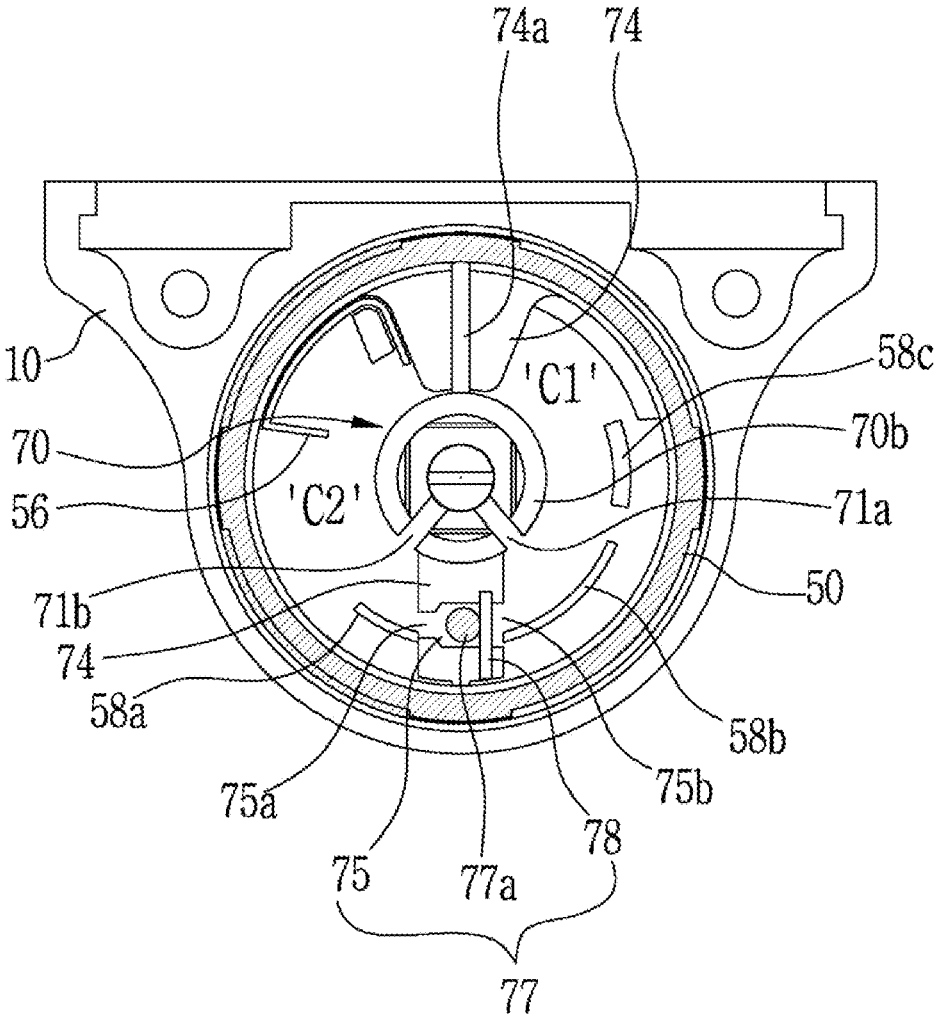
Figure 11:
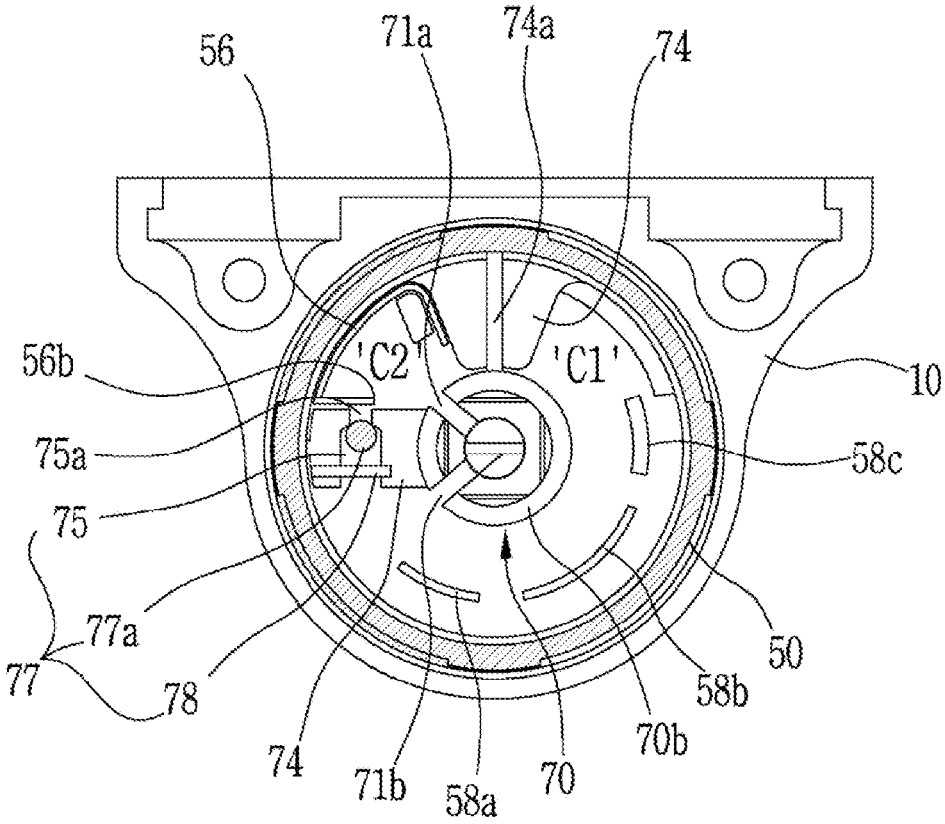

If the door D is more open, as shown in FIGS. 10 and 11, the rotary vane 74 is kept rotated in the clockwise direction toward the opening angle-restricting member 56, and the oil in the second chamber C2 is moved to the first chamber C1 through the oil-passing hole 75. At this time, as the opening angle of the door D becomes large, the elastic force of the spiral spring 30 becomes increased.

If the door D is completely opened, the rotary vane 74 is brought into close contact with the other side 56*b* of the opening angle-restricting member 56. In this state, if the door D is released from the user passing the door D, the external force applied to the door D is removed and the door D is returned to its original position by means of the elastic force of the spiral spring 30.

At this time, the rotary vane 74 is rotated in the counter-clockwise direction, and the oil in the first chamber C1 is introduced into the first inlet 75*a* of the oil-passing hole 75. Through the oil pressure, the ball valve 77*a* closes the second inlet 75*b* of the oil-passing hole 75. Accordingly, the oil in the first chamber C1 is passed sequentially through the first passage 71*a*, the connection passage 71*c* and the second passage 71*b* pierced through the interior of the intermediate portion 70*b* of the activating shaft 70 and is then moved to the second chamber C2, thereby closing the door D at an appropriate speed, while preventing the sudden closing of the door D.

As shown in FIG. 6, through the delaying sections D1, D2 and D3 and the accelerating sections S1, S2 and S3 to the state where the door D is completely closed (at)0° from the state where the door D is completely open (at)180°, the door D is closed at slow and fast speeds. During the rotary vane 74 is passed through the respective accelerating sections S1, S2 and S3, the oil in the first chamber C1 is moved to the second chamber C2 via the first passage 71*a*, the connection passage 71*c* and the second passage 71*b* as well as the first to third accelerating grooves 58*a*, 58*b* and 58*c*, thereby increasing the closing speed of the door D.

The door D has a closing force of inserting the latch of the door D into the locking groove of the door frame F through the final accelerating section S3, and in this case, as shown in FIG. 6, the starting point of the accelerating section S3 is a point where the door D is at about 5°.

Figure 12:
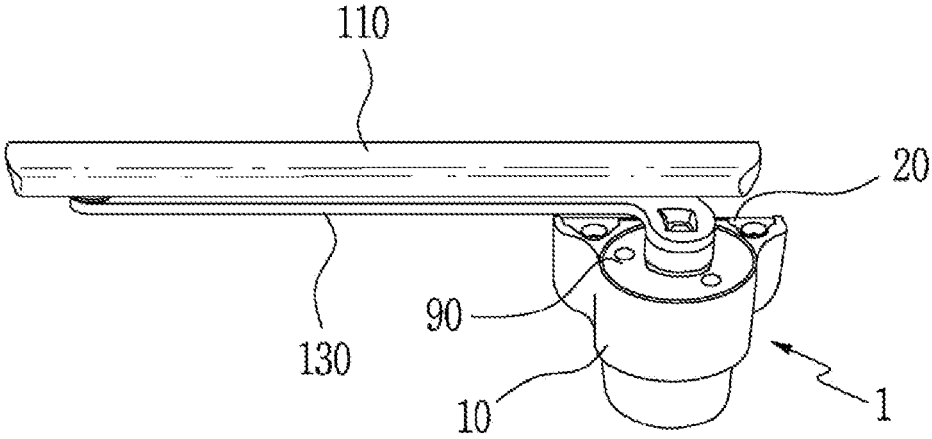
FIGS. 12 and 13 are views showing the sliding arm type automatic door closer according to the present invention.
Figure 13:
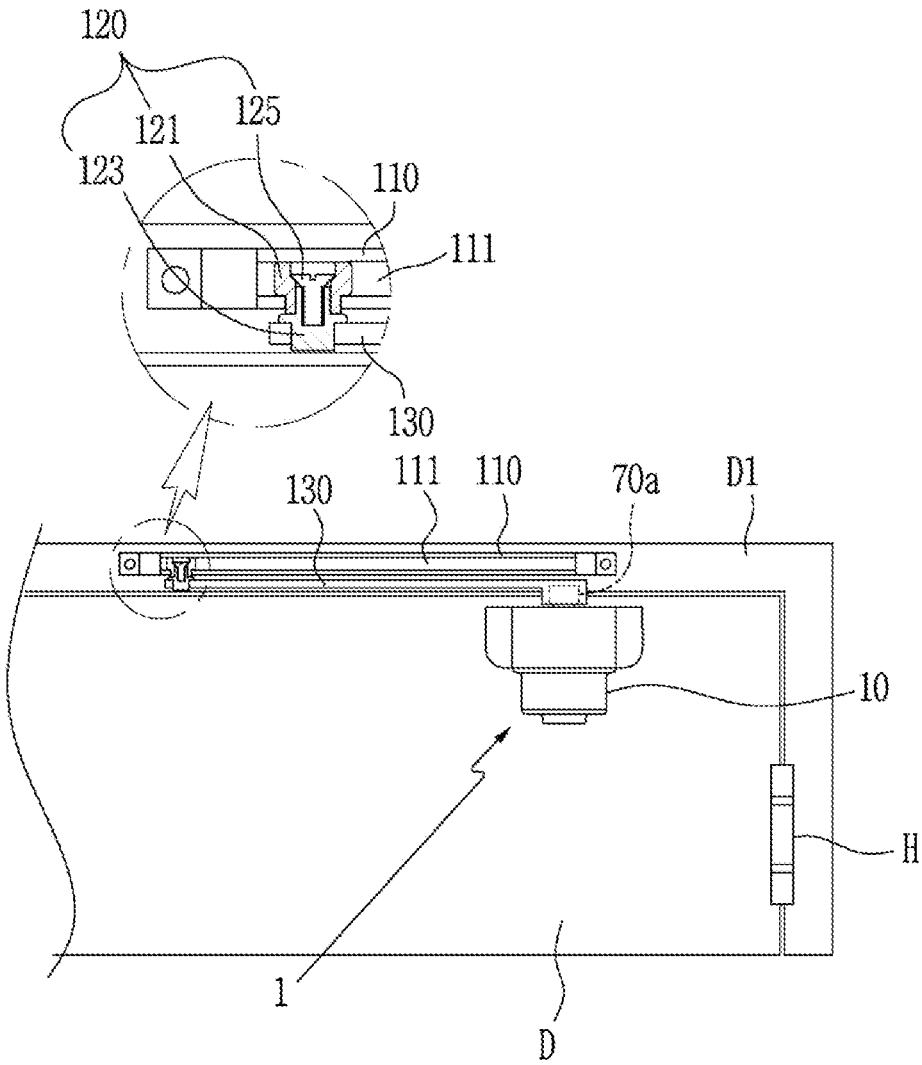
Figure 14:
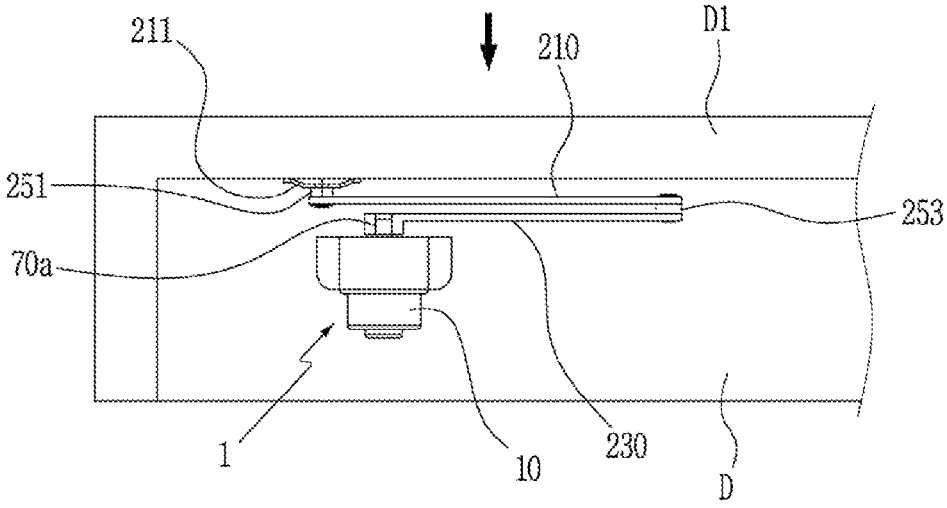
FIGS. 14 and 15 are views showing the link arm type automatic door closer according to the present invention.
Figure 15:
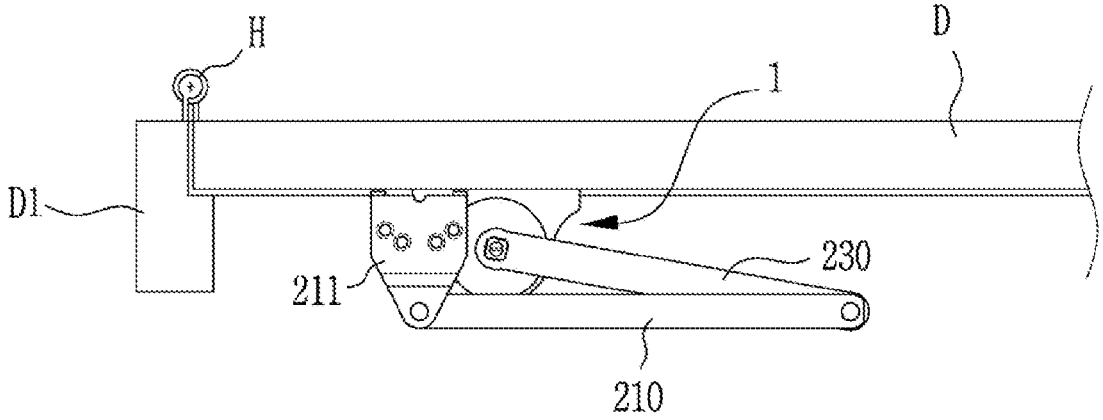
Figure 16:
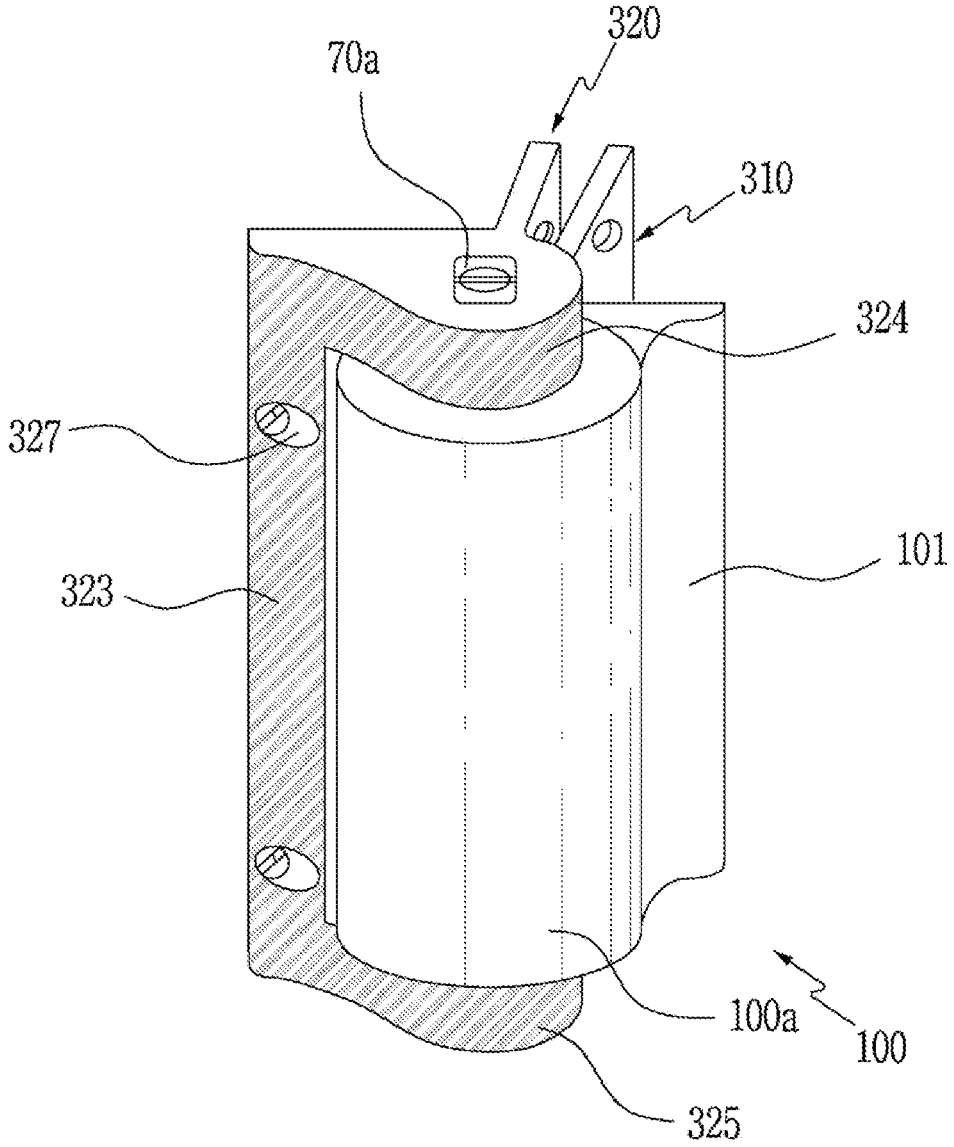
FIGS. 16 to 19 are a perspective view showing the butterfly hinge type automatic door closer according to the present invention, a plan view showing a first hinge, a partial sectional view showing a second hinge, and an exemplary view showing the installation on a door.
Figure 17:
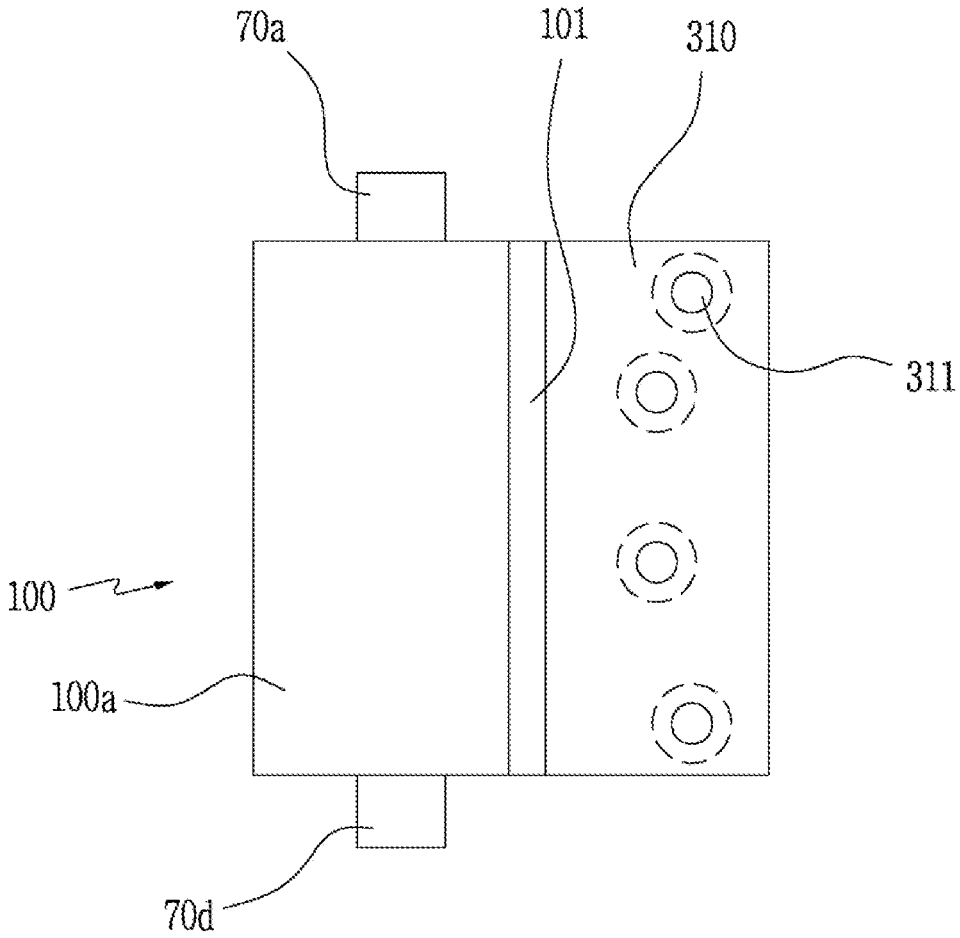
Figure 18:
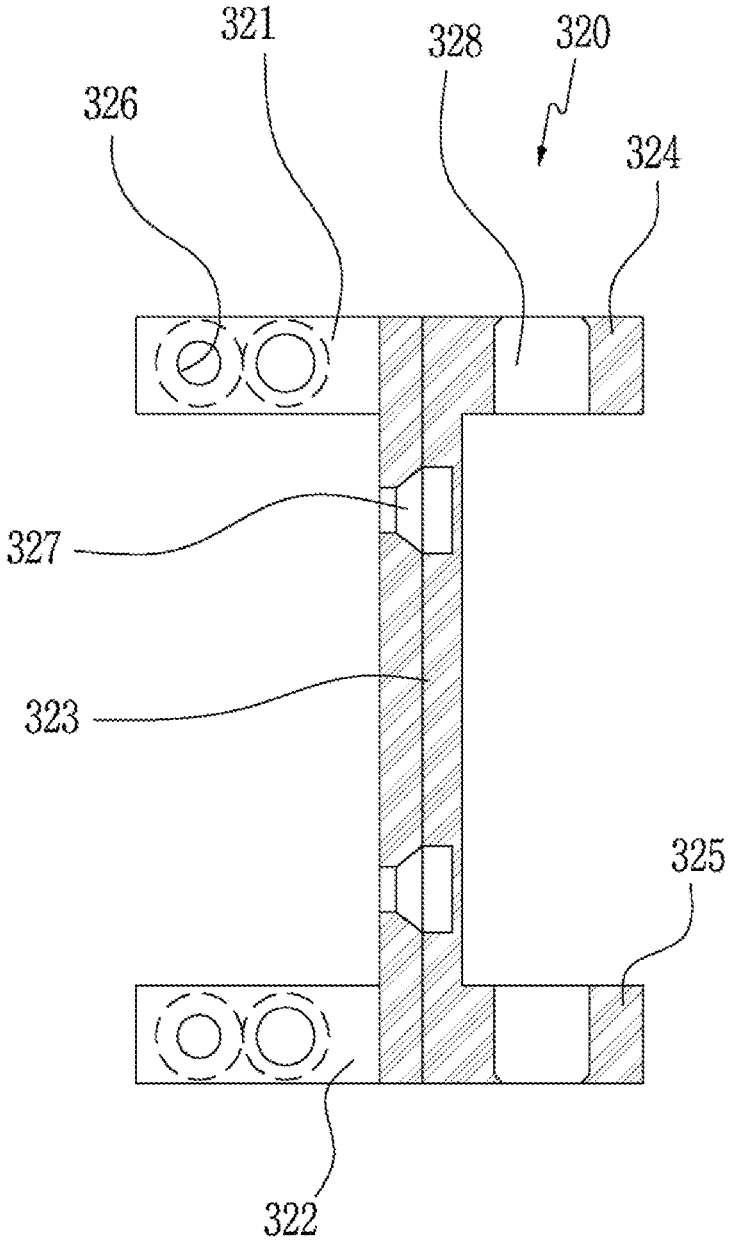

On the other hand, the door closer 1 according to the present invention can be used as a sliding arm type door closer, as shown in FIGS. 12 and 13, as a link arm type door closer, as shown in FIGS. 14 and 15, and with a butterfly hinge structure, as shown in FIGS. 16 and 17.

Referring to FIGS. 12 and 13, the sliding arm type door closer includes a rail member 110 having a predetermined length disposed on the top end of the door frame F and a link member 130 having one end connected to the upper portion 70*a* of the activating shaft 70 of the door closer 1. In this case, the other end of the link member 130 is slidingly connected to the rail member 110 through a roller member 120.

The roller member 120 includes a first member 121 slidingly moving along a rail groove 111 of the rail member 110, a second member 123 hinge-connected to the other end of the link member 130, and a connection screw 125 adapted to fasten the first member 121 and the second member 123 to each other.

According to the sliding arm type door closer, at the time when the door D is open and closed, the link member 130 is turned and at the same time slides in the state of being connected to the rail member 110.

Referring to FIGS. 14 and 15, the link arm type door closer includes a first link rod 210 having one end hinge-connected to a bracket 211 fixed to the top end of the door frame F and a second link rod 230 having one end hinge-connected to the other end of the first link rod 210 and the other end fixedly connected to the upper portion 70*a* of the activating shaft 70 of the door closer 1.

The first link rod 210 serves as a driven link, and the second link rod 230 a drive link.

The first link rod 210 and the second link rod 230 are folded to each other in the state where the door D is closed and are unfolded from each other in the state where the door D is open.

A reference symbol H in FIGS. 13 and 15 indicates a hinge connecting the door D and the door frame F, and reference numerals 251 and 253 indicate spacers.

In the above-mentioned preferred embodiments of the present invention, the automatic door closer is disposed at the upper side of the door and is connected to the upper door frame through the sliding arm type and link arm type link devices, but a bracket structure for mounting the automatic door closer can be changed to a butterfly hinge structure, as shown in FIGS. 16 to 19, so that the automatic door closer is disposed between the door D and the door frame F.

That is, the door closer is mounted on the side of the door D through bufferfly type first and second hinges 310 and 320. In this case, the door closer 100 has a cylindrical main housing 100*a* in such a manner as to outwardly protrude the upper portion 70*a* and the lower portion 70*d* of the activating shaft 70 from the upper and lower portions thereof.

Also, the door closer 100 has an extended portion 101 extended from one side of the main housing 100*a* so as to form a relatively large contacted surface with the door D and to serve as a reinforcing plate. The first hinge 310 is extended from the extended portion 101 in such a manner as to be bent perpendicularly thereto and fixed to the side of the door D. In this case, the first hinge 310 has a plurality of screw holes 311 formed thereon in such a manner as to be fixed to the door D by means of a plurality of fixing screws.

On the other hand, the second hinge 320, which is provided to correspond to the first hinge 310, has upper and lower coupling portions 324 and 325 coupled to the upper portion 70*a* and the lower portion 70*d* of the activating shaft 70 extended from the upper and lower portions of the main housing 100*a* in such a manner as to suppress the rotation of the activating shaft 70, and a connection portion 323 adapted to connect the upper and lower coupling portions 324 and 325 with each other. Further, the upper and lower coupling portions 324 and 325 have the respective flat contacted surface formed on one side thereof in such a manner as to be contacted with the door frame F, which is similar to the first hinge 310, and upper and lower hinges 321 and 322 extended from one side of the contacted surface in such a manner as to be bent perpendicularly thereto and fixed to the side of the door frame F. In this case, the upper and lower hinges 321 and 322 have a plurality of screw holes 326 formed thereon in such a manner as to be fixed to the door frame F by means of a plurality of fixing screws, and the connection portion 323 has a plurality of screw holes 327 formed thereon in such a manner as to be fixed to the door frame F.

Figure 19:
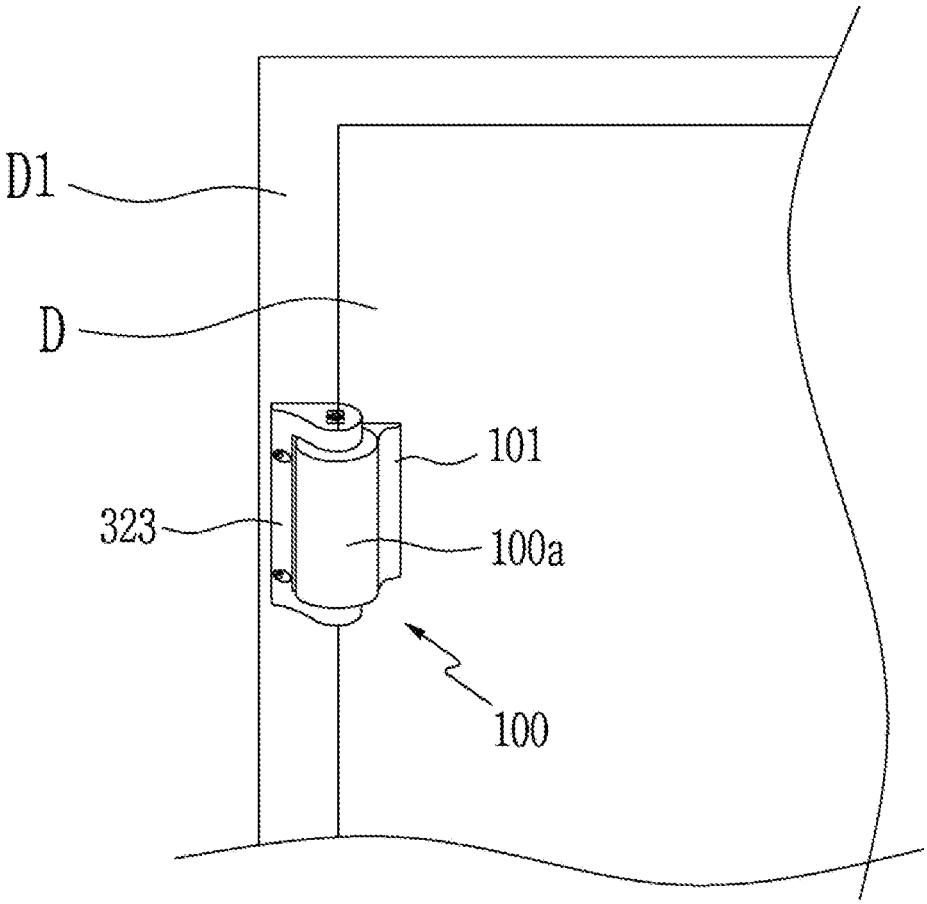

According to the present invention, as shown in FIG. 19, the door closer 100 is mounted on the sides of the door D and the door frame F through the first and second butterfly type hinges 310 and 320, and in this case, since the first and second hinges 310 and 320 are inserted between the door D and the door frame F, they are not shown therein.

That is, one side end portion of the door D is coupled between the first hinge 310 and the extended portion 101, and one side end portion of the door frame F is coupled between the upper and lower hinges 321 and 322 of the second hinge 320 and between the upper and lower coupling portions 324 and 325.

As a result, the first hinge 310 has the extended portion 101, serving as a reinforcing plate, formed perpendicularly thereto in such a manner as to be extended from the main housing 100*a*, and the second hinge 320 has the upper and lower hinges 321 and 322 formed perpendicularly to the upper and lower coupling portions 324 and 325, so that even if a strong external force like strong wind is applied to the door D, it is distributed to provide high durability to the door closer 100.

According to the present invention, the automatic door closer can basically prevent the oil during working from flowing to the outside, which removes the causes of the firing by the oil leaking to the outside upon the installation on a fire-proof door.

Unlike the conventional practices, further, the automatic door closer according to the present invention can have the independently formed hydraulic circuits for the oil moving between the first and second chambers at the time when the door is open and closed, through the damper housing and the activating shaft, thereby improving the stability of the operation and the functions of the check valve, and the automatic door closer according to the present invention can vary the closing speed of the door more precisely through the speed-adjusting bolt.

Moreover, the automatic door closer according to the present invention can be simple in configuration and easy in machining and assembling, while reducing the whole size thereof to a compact size.

Additionally, the automatic door closer according to the present invention can adopt the spiral spring having a substantially low stress variation value, thereby enabling a user to open the door, without the application of any strong force thereto, and can provide a good elastic force at the time when the door is closed, thereby gently performing the door closing operation.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

[Industrial Applicability]

The automatic door closer according to the present invention performs the direct control of the rotary motion of the door, which is usefully applied to doors for building materials, especially, fire-proof doors.

The invention claimed is:

1. An automatic door closer comprising:

a main housing mounted on a door and having a shape of a cylinder having a closed lower portion;

a damper housing disposed along an inner periphery of an upper portion of the main housing so as to divide an interior of the main housing into an upper chamber and a lower chamber, the damper housing having oil charged thereinto and a fixed vane formed at one side of the inner peripheral surface thereof in such a manner as to be projected toward a center thereof, a cover adapted to be fixedly coupled to the upper periphery of the main housing so as to maintain a sealing state with the damper housing;

an activating shaft having one end extended to an outside through the cover in such a manner as to be rotatably supported and the other end rotatably supported against a bottom surface of the main housing through the damper housing, the one end extended to the outside being connected to a door frame through a link;

a rotary vane formed integrally to the outer periphery of the activating shaft so as to divide the interior of the damper housing into first and second chambers, together with the fixed vane;

a return spring mounted in the lower chamber in such a manner as to be compressed at a time when the door is open and to provide a returning force of returning the activating shaft to an initial setting position at a time when the door is closed;

damping means adapted to control opening and closing speeds of the door and to selectively provide a damping function if the activating shaft and the rotary vane are rotated in a closing direction of the door by means of the returning force of the return spring; and further comprising closing speed-controlling means by angle for reducing the damping force generated by the damping means, according to a predetermined opening angle of the door, when the activating shaft and the rotary vane are rotated in the closing direction of the door so as to control the closing speed of the door according to the predetermined opening angle of the door, the closing speed-controlling means by angle comprises at least one accelerating groove formed on the bottom surface of the damper housing to form at least one accelerating section in the circumferential direction, and the section where the accelerating groove is not formed is set as a delaying section delaying the closing speed of the door.

2. The automatic door closer according to claim 1, wherein the damping means comprises a check valve disposed at a first hydraulic circuit, formed on the rotary vane and connecting to the first and second chambers, so as to open the first hydraulic circuit at the time when the door is open and to shut the first hydraulic circuit at the time when the door is closed.

3. The automatic door closer according to claim 1, further comprising closing speed-controlling means adapted to control the closing speed of the door through the adjustment of an amount of oil moving between the first and second chambers.

4. The automatic door closer according to claim 3, wherein the closing speed-controlling means comprises:

a second hydraulic circuit connecting to the first and second chambers from the front and rear ends of the rotary vane through the intermediate portion of the activating shaft; and a speed-adjusting bolt disposed at the second hydraulic circuit so as to control the closing speed of the door through the adjustment of an amount of oil of the second hydraulic circuit.

5. The automatic door closer according to claim 4, wherein the second hydraulic circuit comprises:

a first passage extended from the front end of the rotary vane to the intermediate portion of the activating shaft in such a manner as to communicate with the first chamber;

a second passage parallel to the first passage at a different height from the first passage and extended from the rear end of the rotary vane to the intermediate portion of the activating shaft in such a manner as to communicate with the second chamber; and a connection passage communicating with the first passage and the second passage in a perpendicular relation with the first passage and the second passage, and wherein the speed-adjusting bolt is screw-coupled to the activating shaft in the vertical direction so as to adjust the opening degree of the connection passage.

6. The automatic door closer according to claim 2, wherein the check valve comprises:

the first hydraulic circuit formed on the rotary vane so as to move to the first and second chambers; and a ball valve disposed in the first hydraulic circuit so as to open the first hydraulic circuit at the time when the door is open and to shut the first hydraulic circuit at the time when the door is closed.

7. The automatic door closer according to claim 1, further comprising:

an initial position-setting protrusion formed at one side of the fixed vane along the inner peripheral surface of the damper housing so as to set an initial position of the door; and an opening angle-restricting member disposed at the other side of the fixed vane so as to restrict the opening angle of the door.

8. The automatic door closer according to claim 1, wherein the return spring is disposed with an elastic force in the main housing in such a manner as to be rotated to a given angle in one direction and to provide a final closing force at the time when the door is closed.

9. The automatic door closer according to claim 1, further comprising:

a rail member disposed on the top end of a door frame and having a rail groove; a link member having one end connected to the upper portion of the activating shaft; and a roller member adapted to slidingly connect the other end of the link member along the rail groove of the rail member.

10. The automatic door closer according to claim 1, wherein the automatic door closer is disposed on the door, and the upper portion of the activating shaft is connected to the door frame through a two-bar linkage.

11. The automatic door closer according to claim 1, further comprising:

a first hinge extended from an extended portion in such a manner as to be bent perpendicularly thereto and fixed to the side of the door, the extended portion being extended from one side of the main housing so as to form a contacted surface with the door; and a second hinge having upper and lower coupling portions being coupled to both end portions of the activating shaft extended up and down from the main housing and a connection portion adapted to connect the upper and lower coupling portion to each other, the second hinge being extended from the upper and lower coupling portions in such a manner as to be bent perpendicularly thereto and fixed to the side of the door frame.

12. The automatic door closer according to claim 1, wherein the automatic door closer is disposed on the door by means of a fixing bracket detachably mounted thereon.

13. The automatic door closer according to claim 1, further comprising: a first bearing disposed on the bottom surface of the main housing so as to rotatably support he lower portion of the activating shaft; and a second bearing having a top portion disposed on the cover so as to rotatably support the upper portion of the activating shaft.

* * * * *